United States Patent [19]

Harris

[11] 4,023,498

[45] May 17, 1977

[54] OPTICAL SWITCH

[75] Inventor: Paul Harris, Madison, N.J.

[73] Assignee: The United States of America as represented by the Secretary of the Army, Washington, D.C.

[22] Filed: Apr. 26, 1976

[21] Appl. No.: 680,317

[52] U.S. Cl. ..... 102/70.2 R; 102/70 B; 102/78; 250/576; 350/267

[51] Int. Cl.[2] ..... F42C 13/02

[58] Field of Search ..... 250/576, 573, 343, 344, 250/345, 346; 200/DIG. 36; 350/267; 102/78, 70.2 R, 70 B

[56] References Cited

UNITED STATES PATENTS

| | | | |
|---|---|---|---|
| 3,437,041 | 4/1969 | Hart et al. | 102/70.2 R |
| 3,707,331 | 12/1972 | George et al. | 250/576 X |
| 3,869,215 | 3/1975 | Nolan | 250/576 X |
| 3,869,613 | 3/1975 | Link | 250/343 |
| 3,922,551 | 11/1975 | Williams | 250/343 |

*Primary Examiner*—David H. Brown
*Attorney, Agent, or Firm*—Nathan Edelberg; A. Victor Erkkila; Thomas R. Webb

[57] ABSTRACT

An optical switch, which may be a part of a fuze for an explosive projectile, comprises a housing made up of a hollow cylindrical part with two end plates welded thereto and having a pair of aligned glass windows sealed through opposite sides for transmitting light transversely therethrough, a gas piston with O-ring seals slidable in the housing to define an end wall of a variable volume gas chamber therein and adapted to be moved by inertia during projectile launch to decrease the volume of the chamber and thereby increase the gas pressure, means for locking the piston in the new position, a valve in the housing for admitting a light attenuating gas to the chamber, an adjustable pressure relief valve in the housing adapted to open when the internal gas pressure exceeds the external pressure by a given amount, a light source positioned adjacent to the outside of one of the windows to project light through the windows and the attenuating gas, and a light-sensitive device positioned on the other side of the housing to receive the attenuated light. When the intensity of the light received by the device equals a critical value, the device responds by performing a desired function, such as arming a firing circuit of the fuze. The gas pressures in the chamber before and after piston movement are higher than a critical pressure at which the light reaching the output device has the critical value. When the projectile is projected to a desired altitude, the reduced atmospheric pressure causes the relief valve to open, reducing the chamber pressure below the critical pressure, thereby exciting the light sensitive device to arm the fuze.

The switch may be used with a gas chamber of fixed volume, with a higher initial gas pressure.

9 Claims, 4 Drawing Figures

OPTICAL SWITCH

GOVERNMENTAL INTEREST

The invention described herein may be manufactured, used and licensed by or for the government for governmental purposes without the payment to me of any royalty thereon.

BACKGROUND AND SUMMARY OF THE INVENTION

The present invention relates to a variable transmission optical switch, and particularly to a projectile fuze including an optical switch for arming the fuze during projectile launch.

A variable transmission optical switch disclosed in U.S. Pat. No. 3,560,077 to Walter R. Sooy et al. comprises a housing having optical windows for passing light therethrough and containing a light absorbing liquid, and means for moving one of the windows to change the thickness of the liquid layer to vary the light transmission.

Applicant's invention provides a variable transmission optical switch comprising a housing having a pair of aligned optical windows for passing light therethrough and containing a light attenuating gas is the light path, and means for varying the pressure and density of the gas to vary the intensity of the light transmitted. For example, the gas may be contained in the housing at a given pressure and density at which the light attenuation is high, and the gas pressure may be reduced by means of a pressure relief valve in the housing which opens at a predetermined reduced external pressure to reduce the density of the gas. The optical switch may be carried by a projectile fuze launched to a critical altitude at which the relief valve opens and the transmitted light energizes a light sensitive device to arm the fuze. The housing is preferably provided with a piston actuated by inertia during projectile launch to decrease the gas volume and thereby increase the pressure of the gas from an intermediate to a high value.

DETAILED DESCRIPTION OF A PREFERRED EMBODIMENT

Figure 1:
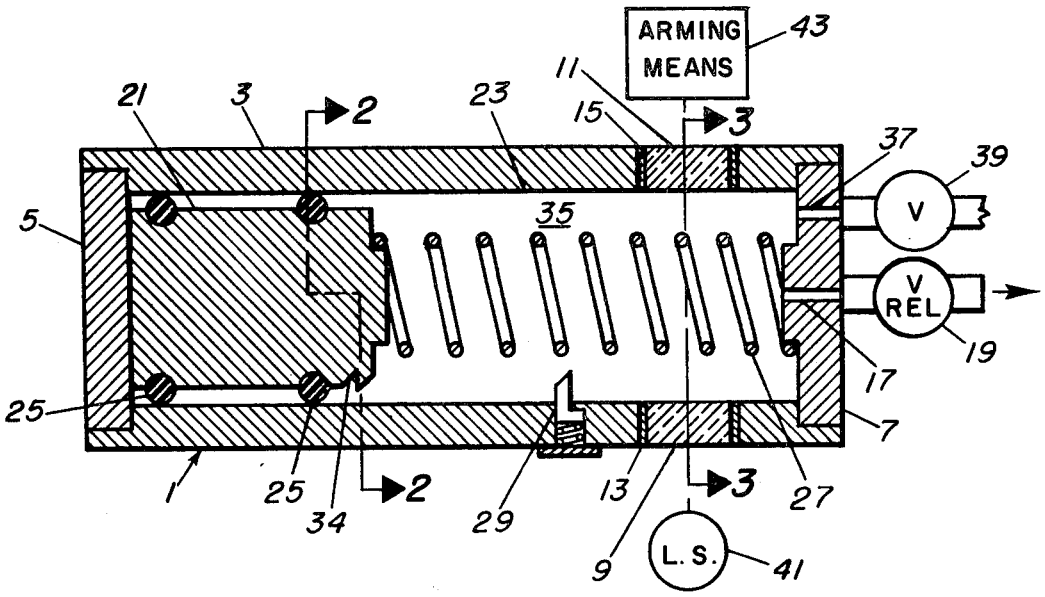
FIG. 1 is an axial section view, taken along line 1—1 of FIG. 2, of an optical switch embodying the present invention, with the gas piston in its initial position.

The optical switch, shown as an example in FIGS. 1–4, comprises a metal housing 1 made up of a hollow cylindrical part 3 and two end plates 5 and 7 sealed thereto, as by welding. Two optical windows 9 and 11, e.g., of glass, are sealed through opposite sides of the part 3, as by Kovar seals 13 and 15, in alignment with each other near one end of the housing to permit transmission of light transversely therethrough. The end plate 7 which is adjacent to the windows 9 and 11 has an axial bore 17 communicating with an external adjustable pressure relief valve 19.

Figure 4:
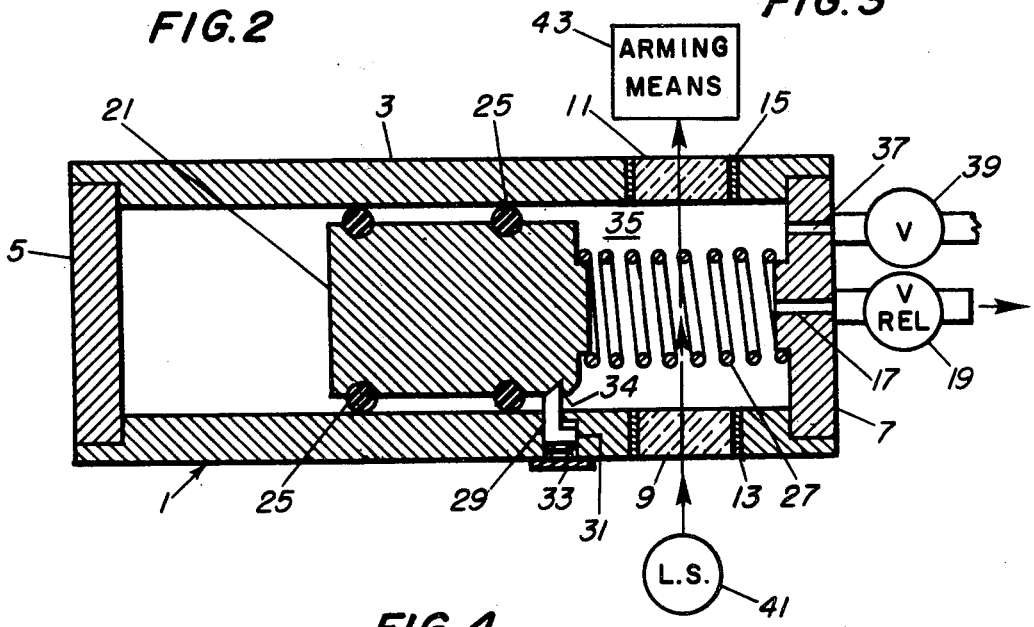
FIG. 4 is a view similar to FIG. 1, showing the piston in its final position.

A cylindrical gas piston 21, having a diameter slightly smaller than the inner wall 23 of part 3, is axially slidably in part 3 from an initial position shown in FIG. 1 to a final position shown in FIG. 4. A gas-tight seal is provided between the piston 21 and the housing wall 23, as by a pair of resilient O-rings 25. A relatively-weak coil spring 27 normally biases the piston 21 towards its initial position. When the piston is moved to the final position of FIG. 4, it is locked in that portion by a spring-drive detent 29, transversely mounted in a bore 31 in the wall of the housing 1 and sealed by a cover plate 33, engaged in a notch 34 in the piston.

The space 35 within the housing 1 between the piston 21 and the end plate 7 is filled, through a bore 37 and valve 39, with a light absorbing and/or reflecting gas at a predetermined initial pressure $p_1$. The optical switch is completed by a suitable light source 41 mounted outside the housing 1 adjacent to window 9 and in alignment with the two windows 9 and 11, and a light-sensitive means or device 43 is mounted adjacent to window 11 to receive the light transmitted through the windows and the gas.

The choice of a gas to be used in the switch depends upon the frequency and bandwidth of the external source 41, the sensitivity of the light-sensitive device 43, and the sensitivity of the relief valve 19. With visible or near infra red light, the gas may be chosen from: $N_2O_2$, $I_2$, HCN and neon.

For a given light source, a given gas, and a given light-sensitive device, there is a critical gas pressure $p_c$ at which the intensity of the light transmitted by the gas to the light-sensitive device 43 is just sufficient to energize the device to produce a useful output, i.e., to close the optical switch; at gas pressures above $p_c$, the optical switch remains open. The switch is closed by reducing the gas pressure below $p_c$.

In a preferred use of the invention, the switch shown in the drawing is incorporated as a part of a fuze for initiating an expolsive projectile, for arming a firing circuit during launch and subsequent flight of the projectile and fuze. In this use, the housing 1 is axially aligned with the longitudinal axis of the projectile so that the piston 21 will be moved forwardly by inertia, by the usual deceleration of the projectile and fuze immediately after set-back to the position shown in FIG. 4 where it is locked by the detent 29. This movement of piston 21 increases the gas pressure from an initial pressure $p_1$, which is above the critical pressure $p_c$, to a second pressure $p_2$ which, with the geometry shown, is about $2p_1$. The initial pressure may be above or below the atmospheric pressure $p_o$ at the launch elevation $h_1$. The relief valve 19 is one that will open and stay open only when the gas pressure $p_2$ in port 17 is a given increment $\Delta p$ above the atmospheric pressure $p_o$. Thus the gas pressure $p_2$ must be less than $(p_o + \Delta p)$ to prevent premature opening of the relief valve 19. However, as soon as the projectile carrying the optical switch reaches a given elevation $h_2$ where $p_o' = p_2 - \Delta p$, the relief valve 19 opens, reducing the gas pressure in housing 1 to $p_o'$. The switch is designed so that $p_o' < p_C$, so that opening of valve 19 will result in closing of the optical switch and arming of the fuze.

Figure 2:
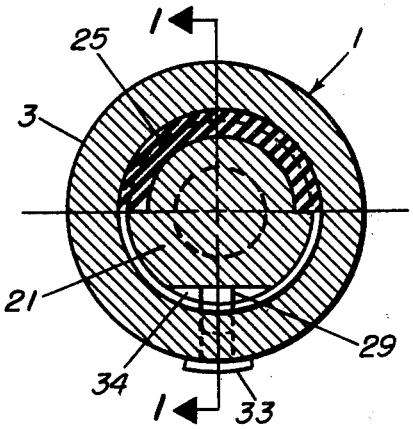
FIGS. 2 and 3 are transverse section views taken on lines 2—2 and 3—3, respectively, of FIG. 1.
Figure 3:
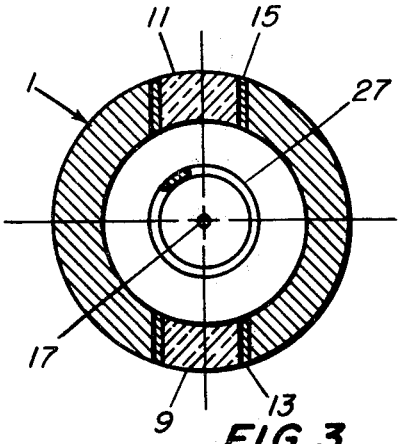

Alternatively, the invention may be used with a fixed gas volume, for example, without moving the piston 21 in FIG. 1 or 2. However, this has the disadvantage that the gas pressure prior to projectile launch must be substantially higher to produce the same result. For example, where the piston 21 is moved as described, the following pressures, in pounds/in.$^2$, may be used:

$p_o = 15$ $p_1 = 10$
$p_2 = 20$
$\Delta p = 6$ to 20
$p_o' = p_2 - \Delta p = 14$ to 0.

A corresponding example with a fixed gas volume is:

$p_o = 15$
$p_1 = 20$
$\Delta p = 6$ to 20
$p_o' = 14$ to 0.

These examples show that the new optical switch disclosed can be adjusted to arm the fuze at any desired altitude.

What is claimed is:

1. An optical switch comprising:

a hollow housing having a pair of aligned windows in opposite side walls defining a transverse optical path therethrough;

an external light source positioned in said path on one side of said housing for projecting light through said housing;

external means positioned in said path on the other side of said housing and responsive to a predetermined light intensity to initiate a desire function;

a light attenuating gas in said housing and in said path for limiting the intensity of the light received by said external means to a value less than said predetermined light intensity in one condition, and for permitting sufficient light to pass therethrough to produce said predetermined light intensity at said external means in another condition; and means for reducing the pressure and density of said gas in said housing sufficiently to increase said received light intensity to said predetermined light intensity.

2. A switch as in claim 1, wherein said gas is selected from the group consisting of $N_2O_2$, Ne, $I_2$ and HCN.

3. A switch as in claim 1, wherein said pressure reducing means includes a pressure relief valve in said housing adapted to open at a given atmospheric pressure in said housing lower than the gas pressure.

4. A switch as in claim 3, further comprising a piston closing one end of said housing and slidable in said housing from a first position producing an initial gas pressure to a second position wherein the volume of said gas is reduced and the gas pressure is increased substantially.

5. A fuze, adapted to be launched in a projectile, comprising the optical switch of claim 4, wherein said piston is adapted to be moved from said first position to said second position by a force during launch of said fuze; said relief valve is adapted to open at an altitude corresponding to said given atmospheric pressure; and said external means is adapted to arm said fuze.

6. A switch as in claim 4, further comprising: a spring for biasing said piston toward said first position; and detent means for latching said piston in said second position.

7. A switch as in claim 4, further comprising gas sealing means between said piston and said housing.

8. A fuze, adapted to be launched in a projectile, including an optical switch comprising:

a hollow housing having a pair of aligned optical windows in opposite side walls defining a transverse optical path therethrough;

an external light source positioned in said path on one side of said housing;

external means positioned in said path on the other side of said housing and responsive to a predetermined light intensity to arm said fuze;

a light attenuating gas in said housing and in said path for limiting the intensity of the light received by said external means to a value less than said predetermined light intensity in one condition, and for permitting sufficient light to pass therethrough to produce said predetermined light intensity at said external means in another condition; and means for reducing the pressure and density of said gas in said housing sufficiently to increase said received light intensity to said predetermined light intensity, comprising a pressure relief valve in said housing adapted to open when said fuze reaches an altitude at which the atmospheric pressure is lower than the gas pressure in said housing.

9. A fuze as in claim 8, wherein said switch further comprises a piston closing one end of said housing and slidable in said housing from a first position producing an intial gas pressure to a second position wherein the volume of said gas is reduced and the gas pressure is increased substantially, said piston being adapted to be moved from said first position to said second position by a force during launch of said fuze.

* * * * *